US010730313B2

(12) United States Patent
Sugai

(10) Patent No.: US 10,730,313 B2
(45) Date of Patent: Aug. 4, 2020

(54) LIQUID EJECTING APPARATUS AND LIQUID EJECTION METHOD

(71) Applicant: SEIKO EPSON CORPORATION, Tokyo (JP)

(72) Inventor: Keigo Sugai, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/016,855

(22) Filed: Jun. 25, 2018

(65) Prior Publication Data

US 2019/0001701 A1 Jan. 3, 2019

(30) Foreign Application Priority Data

Jun. 28, 2017 (JP) ..... 2017-125945

(51) Int. Cl.

| | |
|---|---|
| ***B41J 2/175*** | (2006.01) |
| ***B41J 2/195*** | (2006.01) |
| ***B41J 2/14*** | (2006.01) |
| ***B41J 2/185*** | (2006.01) |

(52) U.S. Cl.

CPC ..... *B41J 2/195* (2013.01); *B41J 2/14201* (2013.01); *B41J 2/175* (2013.01); *B41J 2/185* (2013.01); *B41J 2002/14306* (2013.01); *B41J 2202/05* (2013.01); *B41J 2202/08* (2013.01); *B41J 2202/12* (2013.01)

(58) Field of Classification Search

CPC ..... B41J 2/195; B41J 2/185; B41J 2/14201; B41J 2002/14306; B41J 2202/08; B41J 2202/12; B41J 2202/05; B41J 2/175

See application file for complete search history.

(56) References Cited

U.S. PATENT DOCUMENTS

| | | | | |
|---|---|---|---|---|
| 4,542,391 | A * | 9/1985 | Miyagawa | B41J 2/195 137/468 |
| 2007/0279460 | A1 | 12/2007 | Yokiyama et al. | |
| 2010/0214378 | A1 * | 8/2010 | Katoh | B41J 2/175 347/85 |
| 2014/0071202 | A1 | 3/2014 | Kim et al. | |
| 2016/0297193 | A1 | 10/2016 | Yoshida | |

FOREIGN PATENT DOCUMENTS

| | | | |
|---|---|---|---|
| JP | 2007076113 | A * | 3/2007 |
| JP | 2007-320042 | A | 12/2007 |
| JP | 2014-054828 | A | 3/2014 |
| JP | 2016-199033 | A | 12/2016 |

* cited by examiner

*Primary Examiner* — Sharon A. Polk

(74) *Attorney, Agent, or Firm* — Workman Nydegger

(57) ABSTRACT

A liquid ejecting apparatus includes a liquid chamber that communicates with a nozzle, a communication flow path that communicates with the liquid chamber and that has a first opening into which a liquid flows, a discharge flow path that discharges the liquid and that has a second opening into which the liquid flows, a supply flow path capable of supplying the liquid to the communication flow path and the discharge flow path, and a first slide portion disposed between the supply flow path and the communication flow path and having a first through hole that enables the supply flow path to communicate with the communication flow path. The first slide portion, by sliding along the opening surface of the first opening, changes the position of the first through hole with respect to the communication flow path and changes the flow path resistance of the communication flow path.

12 Claims, 11 Drawing Sheets

<STANDBY STATE>

<STANDBY STATE>

<FILLING STATE>

<EJECTION STATE>

<EJECTION STATE>

LIQUID EJECTING APPARATUS AND LIQUID EJECTION METHOD

BACKGROUND

1. Technical Field

The present invention relates to a liquid ejecting apparatus and a liquid ejection method.

2. Related Art

Regarding a liquid ejecting apparatus that ejects a liquid, for example, JP-A-2007-320042 discloses a configuration in which a flat plate having a through hole formed at a position corresponding to a supply flow path is slid along an opening surface of the supply flow path in order to change the flow path resistance of the supply flow path that supplies the liquid to a pressure chamber.

However, for example, when the plate is reciprocated at a high speed, the plate may generate heat. When the plate generates heat, the properties of the liquid change due to the heat, and there is a possibility that it becomes difficult to perform stable ejection.

SUMMARY

An advantage of some aspects of the invention can be realized as the following aspects.

(1) According to an aspect of the invention, a liquid ejecting apparatus is provided. The liquid ejecting apparatus includes a liquid chamber that communicates with a nozzle, a communication flow path that communicates with the liquid chamber and that has a first opening into which a liquid flows, a discharge flow path that discharges the liquid and that has a second opening into which the liquid flows, a supply flow path capable of supplying the liquid to the communication flow path and the discharge flow path, and a first slide portion disposed between the supply flow path and the communication flow path and having a first through hole that enables the supply flow path to communicate with the communication flow path. The first slide portion, by sliding along the opening surface of the first opening, changes the position of the first through hole with respect to the communication flow path and changes the flow path resistance of the communication flow path. In this case, even if the first slide portion generates heat by sliding, heat can be released by discharging the liquid from the discharge flow path. Therefore, it is possible to suppress a change in the properties of the liquid due to heat, and it is possible to stably eject the liquid.

(2) In the liquid ejecting apparatus of the above aspect, the first slide portion, by changing the position of the first through hole between the communication flow path and the discharge flow path, may change the flow path resistance of the communication flow path and the flow path resistance of the discharge flow path. In this case, because the first through hole can be used for both liquid supply and liquid discharge, the structure can be simplified.

(3) The liquid ejecting apparatus of the above aspect may further include a second slide portion disposed between the supply flow path and the discharge flow path and having a second through hole that enables the supply flow path to communicate with the discharge flow path, and the second slide portion, by sliding along the opening surface of the second opening, may change the position of the second through hole with respect to the discharge flow path and may change the flow path resistance of the discharge flow path. In this case, it is possible to switch whether to discharge liquid or not by moving the second slide portion.

(4) The liquid ejecting apparatus of the above aspect may further include a slide portion integrally having the first slide portion and the second slide portion. In this case, because it is possible to simultaneously change the flow path resistance of the communication flow path and the flow path resistance of the discharge flow path, the structure can be simplified.

(5) In the liquid ejecting apparatus of the above aspect, when the liquid is ejected from the nozzle, the first slide portion may increase the flow path resistance of the communication flow path, and the second slide portion may reduce the flow path resistance of the discharge flow path. In this case, the liquid can be efficiently ejected from the nozzle at the time of ejecting the liquid and heat can be released at the time of ejecting the liquid by discharging the liquid from the discharge flow path.

(6) In the liquid ejecting apparatus of the above aspect, when the nozzle is filled with the liquid, the first slide portion may reduce the flow path resistance of the communication flow path, and the second slide portion may increase the flow path resistance of the discharge flow path. In this case, when the nozzle is filled with the liquid, it is possible to efficiently fill the nozzle with liquid.

(7) In the liquid ejecting apparatus of the above aspect, when the liquid is ejected from the nozzle, the first slide portion may increase the flow path resistance of the communication flow path. In this case, it is possible to efficiently eject the liquid from the nozzle at the time of liquid ejection.

(8) In the liquid ejecting apparatus of the above aspect, an opening area of the second opening may be larger than an opening area of the first opening. In this case, it is possible to efficiently discharge the liquid.

(9) In the liquid ejecting apparatus of the above aspect, a force that the first slide portion receives from a side of the supply flow path may be larger than a force that the first slide portion receives from a side of the communication flow path. In this case, leakage of liquid from between the first slide portion and the communication flow path can be suppressed.

(10) The liquid ejecting apparatus of the above aspect may further include a plurality of sets of the liquid chamber and the communication flow path, and the first slide portion may change the flow path resistance of a plurality of the communication flow paths. In this case, because the flow path resistance of the plurality of the communication flow paths can be changed by a single first slide portion, the structure can be simplified.

(11) In the liquid ejecting apparatus of the above aspect, the first slide portion may slide each time the liquid is ejected from the nozzle. In this case, even if the first slide portion generates heat by sliding, heat can be released by discharging the liquid from the discharge flow path.

The invention can be realized in various aspects other than those of the above-described liquid ejecting apparatus. For example, it can be realized in the form of a liquid ejection method executed by a liquid ejecting apparatus, a computer program for controlling the liquid ejecting apparatus, a non-transitory tangible recording medium in which the computer program is recorded, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
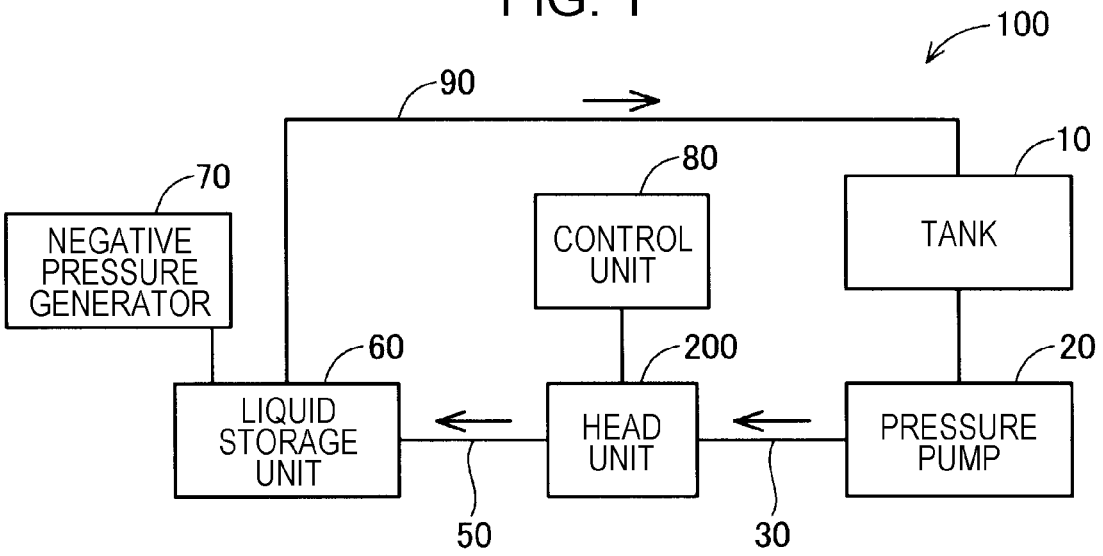
FIG. 1 is an explanatory diagram illustrating a schematic configuration of a liquid ejecting apparatus according to a first embodiment.

FIG. 1 is an explanatory diagram illustrating a schematic configuration of a liquid ejecting apparatus 100 according to a first embodiment of the invention. The liquid ejecting apparatus 100 includes a tank 10, a pressure pump 20, a first flow path 30, a head unit 200, a second flow path 50, a liquid storage unit 60, a negative pressure generator 70, and a control unit 80.

The tank 10 houses a liquid. As the liquid, for example, ink having a predetermined viscosity is housed in the tank 10. The liquid in the tank 10 is supplied to the head unit 200 through the first flow path 30 by the pressure pump 20. The liquid supplied to the head unit 200 is ejected by the head unit 200. The operation of the head unit 200 is controlled by the control unit 80. The control unit 80 is configured as a computer having a CPU and a memory, and controls the operation of the head unit 200 by the CPU executing a program stored in the memory. The program may be recorded on a non-transitory tangible recording medium.

The liquid not ejected by the head unit 200 is discharged to the liquid storage unit 60 through the second flow path 50. The negative pressure generator 70 that can be constituted by any of various pumps is connected to the liquid storage unit 60. The negative pressure generator 70 sucks liquid from the head unit 200 through the second flow path 50 by setting the inside of the liquid storage unit 60 to a negative pressure. The pressure pump 20 and the negative pressure generator 70 function as a liquid supply unit for supplying a liquid to the first flow path 30 by generating a differential pressure between the first flow path 30 and the second flow path 50. Further, one of the pressure pump 20 and the negative pressure generator 70 may be omitted and either of the pressure pump 20 or the negative pressure generator 70 may form a liquid supply unit. As described above, in this embodiment, because liquid that has not been ejected from the head unit 200 is discharged from the head unit 200 to the second flow path 50, it is possible to suppress accumulation of sedimentary components in the liquid in the head unit 200.

In this embodiment, the liquid storage unit 60 and the tank 10 are connected by a circulation flow path 90. The liquid stored in the liquid storage unit 60 is returned to the tank 10 through the circulation flow path 90 and is again supplied to the head unit 200 by the pressure pump 20. In other words, the circulation flow path 90 has a function of supplying the liquid discharged from the second flow path 50 again to the first flow path 30. The circulation flow path 90 may be provided with a pump for sucking liquid from the liquid storage unit 60. In addition, the circulation flow path 90 may be provided with a foreign matter removal filter or a degassing module. Further, it is also possible to omit the circulation flow path 90 and to make the liquid ejecting apparatus 100 not circulate the liquid.

The liquid ejecting apparatus 100 can also be configured as a printer. In this case, for example, the head unit 200 is mounted on a carriage that scans the recording medium, and ejects the liquid onto the recording medium at a timing instructed from the control unit 80.

Figure 2:
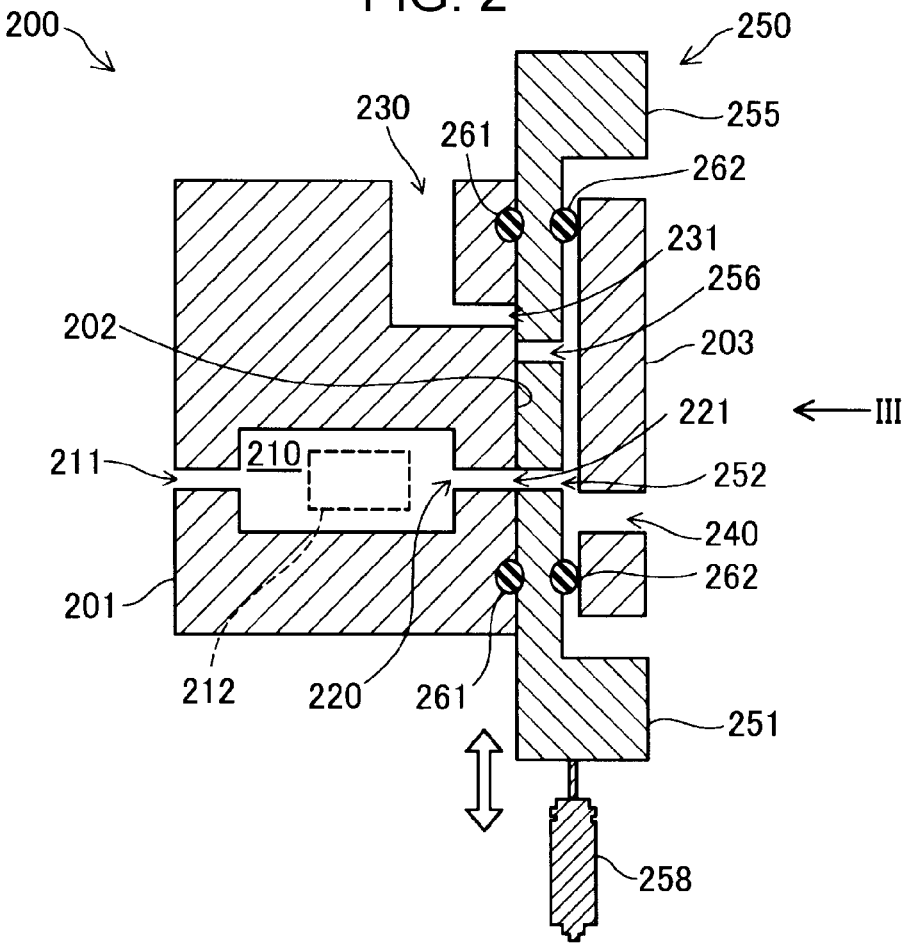
FIG. 2 is a cross-sectional view illustrating a schematic configuration of a head unit.

FIG. 2 is a cross-sectional view illustrating a schematic configuration of the head unit 200. The head unit 200 includes a liquid chamber 210, a communication flow path 220, a discharge flow path 230, a supply flow path 240, and a slide portion 250.

The liquid chamber 210 is a room having a space to which a liquid is supplied. The liquid chamber 210 communicates with a nozzle 211. By changing the volume of the internal space of the liquid chamber 210, the liquid chamber 210 ejects liquid from the nozzle 211. A vibration plate 212 is provided on a portion of the side surface of the liquid chamber 210. A piezo actuator (not illustrated) is in contact with the vibration plate 212. When the piezo actuator is driven, the vibration plate 212 bends accordingly, and the volume of the liquid chamber 210 is changed. The control unit 80 increases the pressure in the liquid chamber 210 by reducing the volume of the liquid chamber 210 by controlling the piezo actuator. When the pressure in the liquid chamber 210 exceeds the meniscus withstanding pressure of the liquid in the nozzle 211, liquid is ejected from the nozzle 211. At this time, at maximum, an amount of liquid corresponding to the change in the volume of the liquid chamber 210 is ejected to the outside from the nozzle 211.

The communication flow path 220 communicates with the liquid chamber 210. The communication flow path 220 has a first opening 221 into which the liquid flows. The liquid flowing into the communication flow path 220 from the first opening 221 is supplied to the liquid chamber 210.

The discharge flow path 230 is a flow path for discharging liquid. The discharge flow path 230 is connected to the second flow path 50 (FIG. 1). The discharge flow path 230 has a second opening 231 into which the liquid flows. In this embodiment, the first opening 221 of the communication flow path 220 and the second opening 231 of the discharge flow path 230 are formed on the same plane.

In this embodiment, a member in which the communication flow path 220 and the discharge flow path 230 are formed is referred to as a main body member 201. The main body member 201 can be formed of any of various metals such as SUS, or resin, silicon, or the like. The surface of the main body member 201 on which the opening surface of the first opening 221 and the opening surface of the second opening 231 are provided will be referred to as a slide surface 202 in the following. A coating film may be formed on the slide surface 202 with a ceramic, zirconia or the like in order to improve the abrasion resistance.

The supply flow path 240 is a flow path that can supply liquid to the communication flow path 220 and the discharge flow path 230. The supply flow path 240 is connected to the first flow path 30 (FIG. 1). The member in which the supply flow path 240 is formed is hereinafter referred to as a supply-flow-path-forming member 203.

The slide portion 250 includes a first slide portion 251 and a second slide portion 255. The first slide portion 251 is disposed between the supply flow path 240 and the communication flow path 220. A portion of the first slide portion 251 interposed between the supply flow path 240 and the communication flow path 220 is formed in a flat plate shape. The first slide portion 251 has a first through hole 252 that enables the supply flow path 240 to communicate with the communication flow path 220. The first slide portion 251, by sliding along the opening surface of the first opening 221, changes the position of the first through hole 252 with respect to the communication flow path 220 and changes the flow path resistance of the communication flow path 220.

The second slide portion 255 is disposed between the supply flow path 240 and the discharge flow path 230. A portion of the second slide portion 255 interposed between the supply flow path 240 and the discharge flow path 230 is formed in a flat plate shape. The second slide portion 255 has a second through hole 256 that enables the supply flow path 240 to communicate with the discharge flow path 230. The second slide portion 255, by sliding along the opening surface of the second opening 231, changes the position of the second through hole 256 with respect to the discharge flow path 230 and changes the flow path resistance of the discharge flow path 230. By moving the second slide portion 255, the control unit 80 can switch whether to discharge the liquid from the discharge flow path 230 or not.

In this embodiment, the first slide portion 251 and the second slide portion 255 are integrally formed as the slide portion 250. Therefore, the slide portion 250 can change the flow path resistance of the communication flow path 220 and the flow path resistance of the discharge flow path 230 at the same time. With such a configuration, the structure of the head unit 200 can be simplified. In this embodiment, in order to prevent the first opening 221 and the second opening 231 from being opened at the same time, the distance between the first through hole 252 and the second through hole 256 in the slide portion 250 in the sliding direction of the slide portion 250 and the distance between the communication flow path 220 (the first opening 221) and the discharge flow path 230 (the second opening 231) in the slide surface 202 are made different from each other. Specifically, the distance between the first through hole 252 and the second through hole 256 in the slide portion 250 is smaller than the distance between the communication flow path 220 (the first opening 221) and the discharge flow path 230 (the second opening 231) in the slide surface 202. Further, the distance between the first through hole 252 and the second through hole 256 in the slide portion 250 may be larger than the distance between the communication flow path 220 (the first opening 221) and the discharge flow path 230 (the second opening 231) in the slide surface 202.

The slide portion 250 is connected to an actuator 258 for moving the slide portion 250 along the slide surface 202. The actuator 258 is controlled by the control unit 80 to slide the slide portion 250 on the slide surface 202. As long as it is possible to slide the slide portion 250, any of various actuators such as a piezo actuator, a solenoid, a magnetostrictive element and the like can be used as the actuator 258. Further, the slide portion 250 may also be referred to as a shutter portion, a plate portion, or the like.

In this embodiment, first seal members 261 are disposed between the slide portion 250 and the slide surface 202. The first seal members 261 are formed of any of various rubber members such as silicone rubber and fluorine rubber members. The first seal members 261 are fixed at positions between which the first opening 221 and the second opening 231 are interposed on the slide surface 202 of the main body member 201. In addition, the first seal members 261 are disposed at positions between which the first through hole 252 and the second through hole 256 are interposed on the surface of the slide portion 250 on the slide surface 202 side. The slide portion 250 slides on the first seal members 261. Further, the first seal members 261 may be fixed to the slide portion 250 rather than to the main body member 201. In addition, the first seal members 261 may be omitted and the slide portion 250 may slide directly on the slide surface 202.

In this embodiment, second seal members 262 are disposed between the supply-flow-path-forming member 203 and the slide portion 250. Like the first seal members 261, the second seal members 262 are formed of any of various rubber members such as silicone rubber and fluorine rubber members. The second seal members 262 are fixed at positions between which the supply flow path 240 is interposed on the surface of the supply-flow-path-forming member 203 on the slide portion 250 side. In addition, the second seal members 262 are disposed at positions between which the first through hole 252 and the second through hole 256 are interposed on the surface of the slide portion 250 on the supply-flow-path-forming member 203 side. The slide portion 250 slides on the second seal members 262. That is, the slide portion 250 slides between the first seal members 261 and the second seal members 262. The space surrounded by the supply-flow-path-forming member 203, the slide portion 250, and the second seal members 262 functions as a portion of the supply flow path 240. Further, the second seal members 262 may be fixed to the slide portion 250 rather than the supply-flow-path-forming member 203.

In this embodiment, it is preferable that the force received by the slide portion 250 (the first slide portion 251 and the second slide portion 255) from the supply flow path 240 side be larger than the force received from the communication flow path 220 side. To be more specific, it is preferable that the sum of the force received by the slide portion 250 from the liquid pressurized by the pressure pump 20 and the pressing force from the second seal members 262 (hereinafter referred to as "first force") be larger than the sum of the forces received by the slide portion 250 from the liquid chamber 210 through the liquid in each of the communication flow paths 220 when the liquid is ejected from each of the nozzles 211 and the pressing force by the first seal members 261 (hereinafter referred to as "second force"). If the first force is larger than the second force, leakage of the liquid from the space between the communication flow path 220 and the slide portion 250 to the outside can be suppressed. Further, if the liquid does not leak to the outside from between the communication flow path 220 and the slide portion 250, the first force can be regarded as being larger than the second force. When the first seal members 261 are omitted from the structure of the head unit 200, the pressing force of the first seal members 261 becomes zero in the above-described second force.

Figure 3:
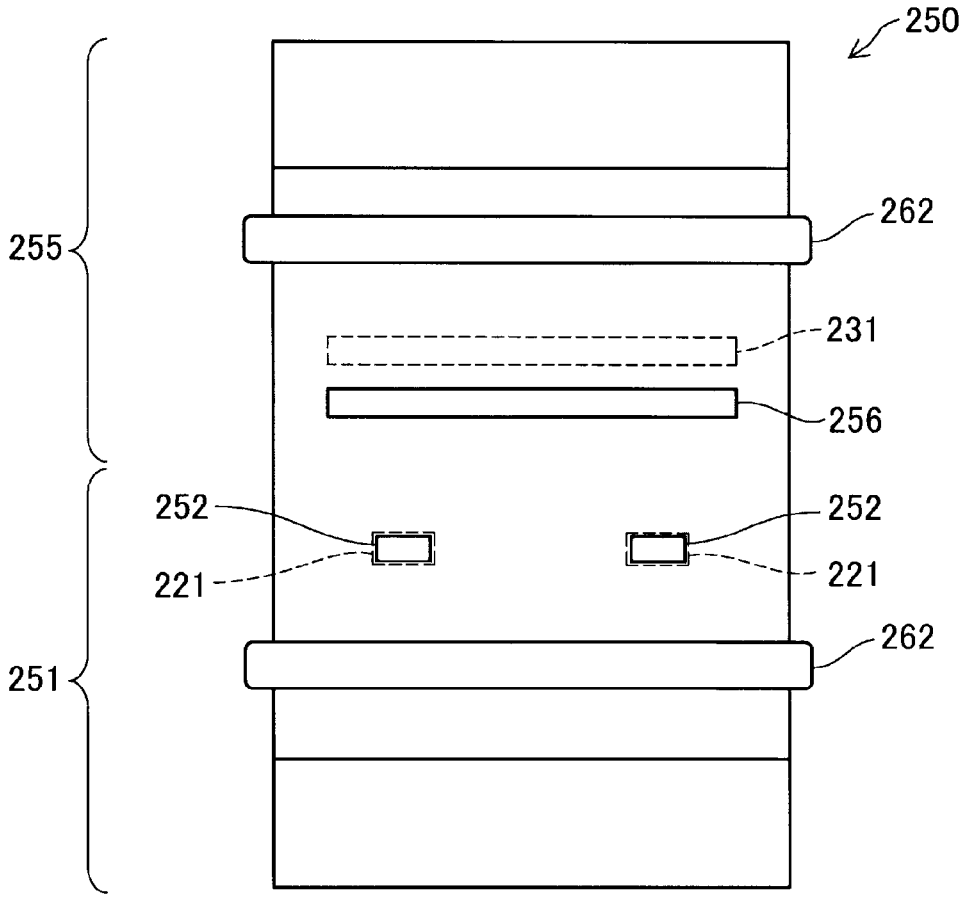
FIG. 3 is a view of a slide portion taken along line III in FIG. 2.

FIG. 3 is a view of the slide portion 250 taken along line III in FIG. 2. In this embodiment, two sets of the nozzle 211, the liquid chamber 210 and the communication flow path 220 illustrated in FIG. 2 are formed in the main body member 201. Therefore, as illustrated in FIG. 3, in the slide portion 250, two first through holes 252 are provided at positions corresponding to the first openings 221 of two communication flow paths 220. Therefore, the flow path resistance of a plurality of the communication flow paths 220 can be changed by a single slide portion 250 (the first slide portion 251). Therefore, the structure can be simplified. In addition, in this embodiment, only a single discharge flow path 230 is formed. Therefore, a single second through hole 256 is provided in the slide portion 250. In this embodiment, the opening area of the second opening 231 (the second through hole 256) is larger than the sum of the opening areas of the first openings 221 (the first through holes 252). Therefore, it is possible to efficiently discharge the liquid from the head unit 200.

Further, the head unit 200 is not limited to the two sets of the nozzle 211, the liquid chamber 210, the communication flow path 220 and the first through hole 252, and may be provided with only one set or three or more sets. In addition, a plurality of sets of the discharge flow path 230 and the second through hole 256 may be provided. In addition, the opening area of the second opening 231 (the second through hole 256) may be smaller than the sum of the opening areas of the first openings 221 (the first through holes 252).

Figure 4:
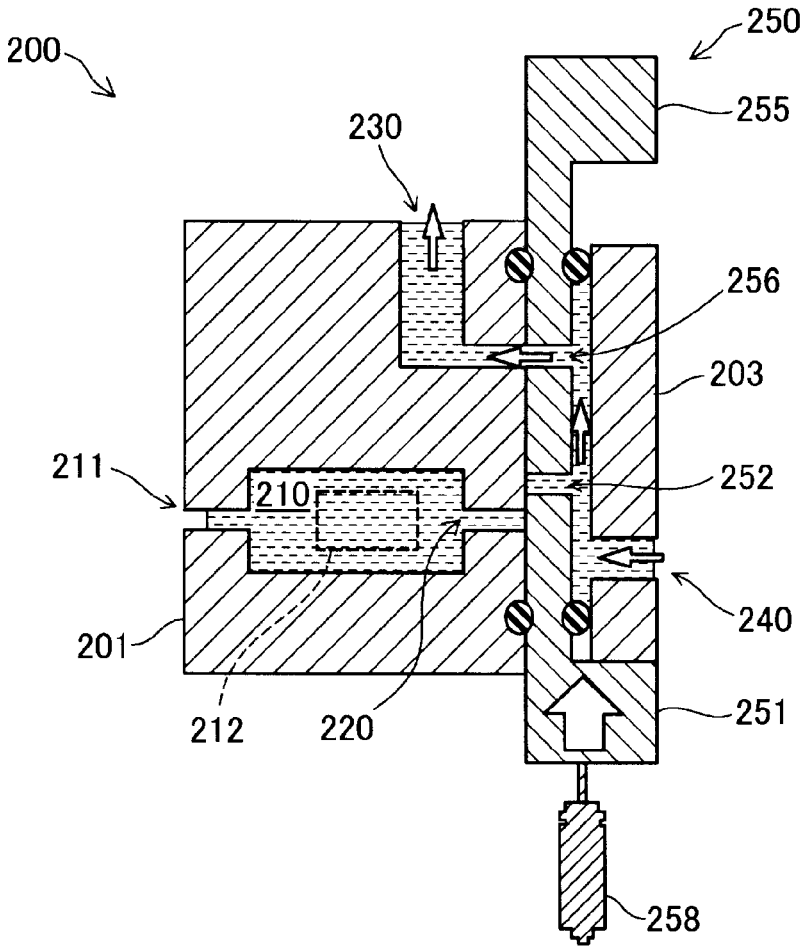
FIG. 4 is an explanatory view illustrating an operation of the head unit in a standby state.
Figure 5:
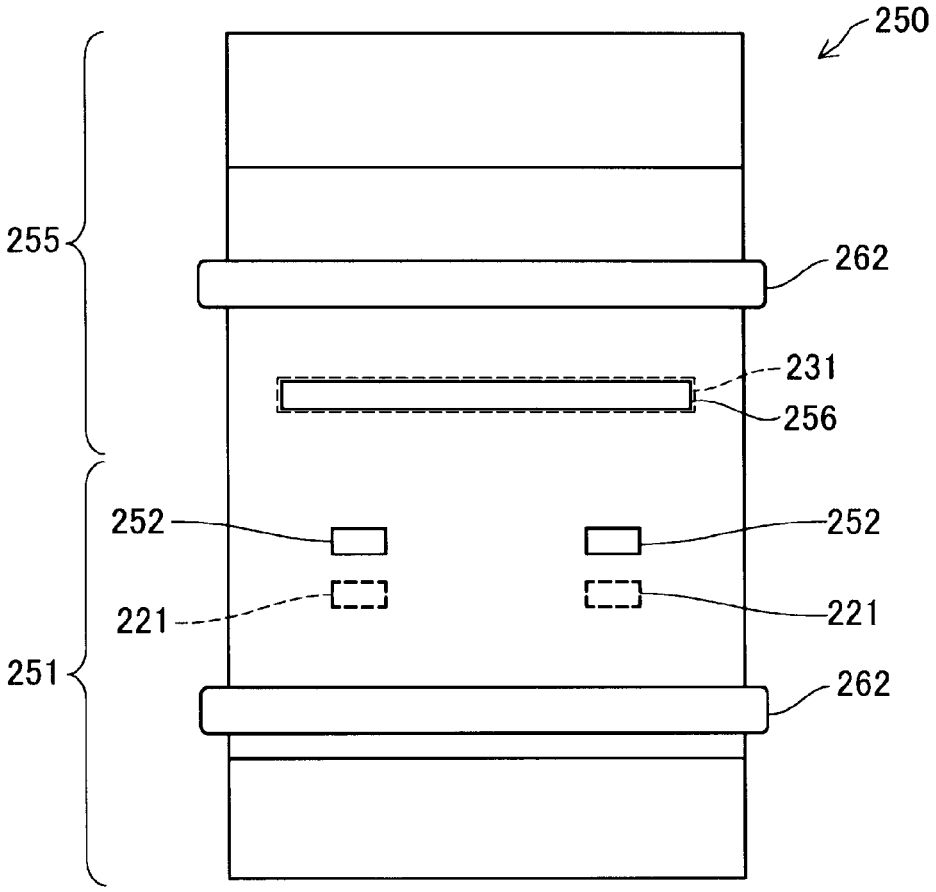
FIG. 5 is a view illustrating the positions of a first through hole and a second through hole in the standby state.

Based on FIGS. 4 to 8, a liquid ejection method executed by the liquid ejecting apparatus 100 will be described. FIG. 4 is an explanatory view illustrating an operation of the head unit 200 in a standby state. FIG. 5 is a view illustrating the positions of the first through holes 252 and the second through hole 256 in the standby state. In the standby state in which liquid is not ejected, the first slide portion 251 increases the flow path resistance of the communication flow paths 220, and the second slide portion 255 reduces the flow path resistance of the discharge flow path 230. To be more specific, the control unit 80 controls the actuator 258 to move the slide portion 250, the second through hole 256 provided in the second slide portion 255 is in communication with the discharge flow path 230, and, further, the first through holes 252 provided in the first slide portion 251 are not in communication with the communication flow paths 220. In this standby state, the liquid supplied from the first flow path 30 to the head unit 200 passes through the supply flow path 240 and is directly discharged from the discharge flow path 230.

Figure 6:
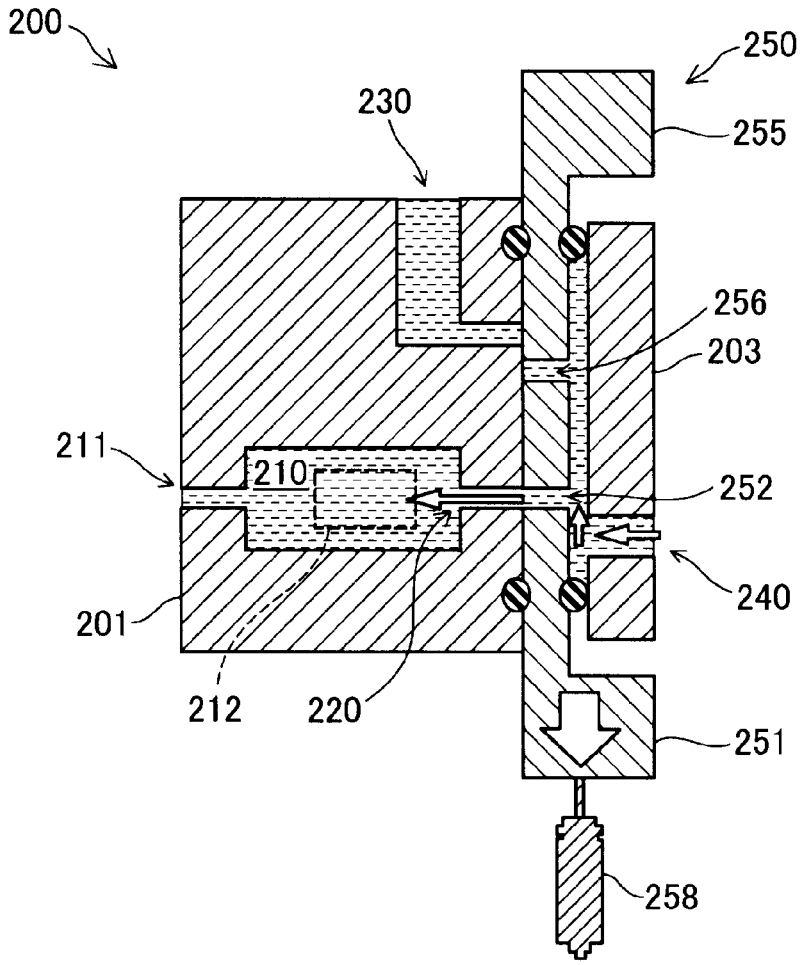
FIG. 6 is an explanatory view illustrating an operation of the head unit in a filling state.

FIG. 6 is an explanatory view illustrating an operation of the head unit 200 in a filling state. After the standby state, in the filling state in which the liquid chambers 210 and the nozzles 211 are filled with liquid in order to eject liquid, the first slide portion 251 reduces the flow path resistance of the communication flow paths 220, and the second slide portion 255 increases the flow path resistance of the discharge flow path 230. To be more specific, the control unit 80 controls the actuator 258 to move the slide portion 250, the second through hole 256 provided in the second slide portion 255 is not in communication with the discharge flow path 230, and, further, the first through holes 252 provided in the first slide portion 251 are in communication with the communication flow paths 220. By doing so, in the filling state, the liquid supplied from the supply flow path 240 is filled into the liquid chambers 210 and the nozzles 211 through the communication flow paths 220 without being discharged from the discharge flow path 230. FIG. 3 illustrates the positions of the first through holes 252 and the second through hole 256 in the filling state.

Figure 7:
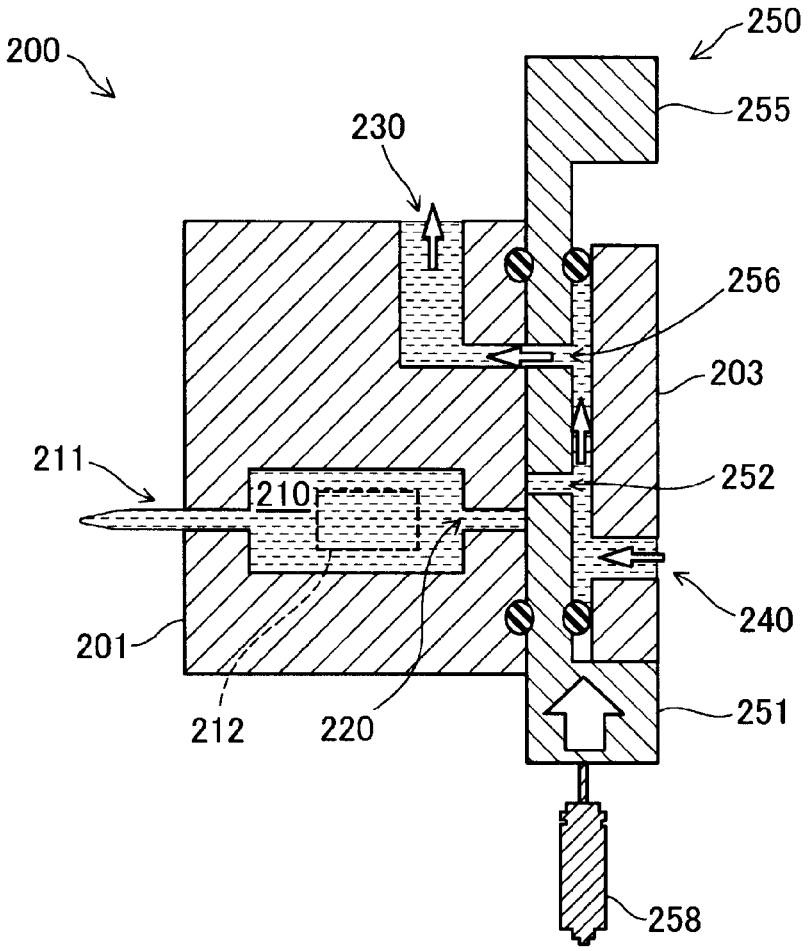
FIG. 7 is an explanatory view illustrating an operation of the head unit in the ejection state.
Figure 8:
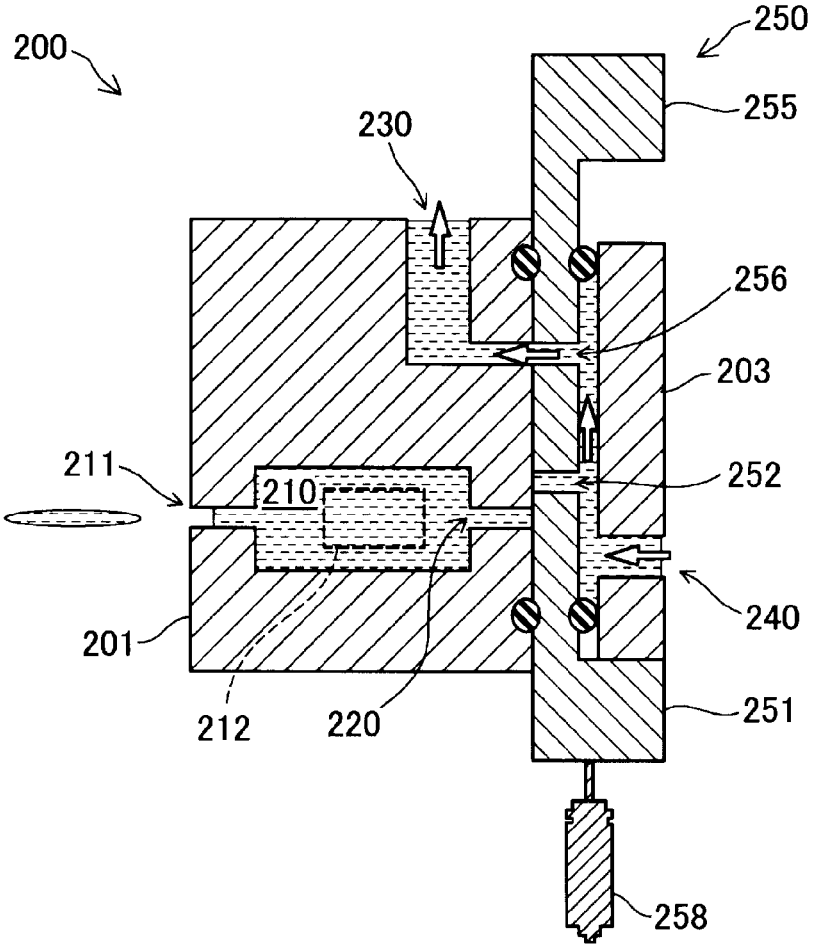
FIG. 8 is a view illustrating a state in which a liquid is ejected from a nozzle.

FIG. 7 is an explanatory view illustrating the operation of the head unit 200 in the ejection state. FIG. 8 is a view illustrating a state in which liquid is ejected from the nozzles 211. In the ejection state in which liquid is ejected after the filling state, the first slide portion 251 increases the flow path resistance of the communication flow paths 220, and the second slide portion 255 reduces the flow path resistance of the discharge flow path 230. To be more specific, the control unit 80 controls the actuator 258 to move the slide portion 250, the second through hole 256 provided in the second slide portion 255 is in communication with the discharge flow path 230, and, further, the first through holes 252 provided in the first slide portion 251 are not in communication with the communication flow paths 220. According to this filling state, because it is possible to suppress backflow of the liquid from the liquid chambers 210 to the communication flow path side, it is possible to efficiently eject the liquid from the nozzles 211. In addition, it is possible to suppress the pressure change in one of the liquid chambers 210 caused by the vibration plate 212 from affecting the other one of the liquid chambers 210 through the communication flow path 220, so that it is possible to stably eject the liquid from each of the nozzles 211. The control unit 80, after the volume of each of the liquid chambers 210 is reduced by the vibration plate 212 and the liquid is ejected from the nozzle 211, reduces the pressure in the liquid chamber 210 and cuts the tail of the ejected liquid by increasing the volume of the liquid chamber 210 by the vibration plate 212. By doing so, as illustrated in FIG. 8, a predetermined amount of liquid is ejected.

The control unit 80 is capable of continuously ejecting liquid droplets from the nozzles 211 by controlling the actuator 258 to repeatedly control the state of the head unit 200 to the above-described standby state, filling state, and ejection state. In this embodiment, when changing from the standby state to the filling state and when changing from the filling state to the ejection state, the slide portion 250 slides. That is, each time the liquid is ejected from the nozzles, the slide portion 250 slides.

In the case where the liquid ejecting apparatus 100 is configured as a printer, the control unit 80, for example, on the basis of a signal output from an encoder for detecting the movement speed or the movement amount of the carriage provided with the head unit 200, drives the actuator 258 that moves the slide portion 250 and the piezo actuator provided in each of the liquid chambers 210 after a certain delay time after the liquid ejection timing. By doing so, it is possible to repeatedly control the state of the head unit 200 to the standby state, the filling state, and the ejection state in synchronization with the movement of the head unit 200.

According to the liquid ejecting apparatus 100 of this embodiment described above, even if the slide portion 250 (the first slide portion 251 and the second slide portion 255) generates heat due to the friction accompanying the sliding, heat can be released by discharging the liquid from the discharge flow path 230. Therefore, it is possible to suppress a change in the properties of the liquid due to heat, and it is possible to stably eject the liquid. In particular, in this embodiment, each time the liquid is ejected, the slide portion 250 slides, so there is a high possibility that the slide portion 250 generates heat due to friction with the first seal members 261 and the second seal members 262. Therefore, the effect of releasing heat by discharging the liquid from the discharge flow path 230 is marked.

In addition, according to this embodiment, because the slide portion 250 integrally includes the first slide portion 251 and the second slide portion 255, the flow path resistance of the communication flow paths 220 and the flow path resistance of the discharge flow path 230 can be changed at the same time. Consequently, the structure can be simplified.

In addition, in this embodiment, when liquid is ejected from the nozzles 211, the first slide portion 251 increases the flow path resistance of the communication flow paths 220, and the second slide portion 255 reduces the flow path resistance of the discharge flow path 230. Therefore, at the time of ejecting the liquid, it is possible to efficiently eject the liquid from the nozzles 211, and at the same time, by discharging the liquid from the discharge flow path 230, the heat generated by the sliding of the slide portion 250 can be released.

In addition, in this embodiment, when filling the nozzles 211 with liquid, the first slide portion 251 reduces the flow path resistance of the communication flow paths 220, and the second slide portion 255 increases the flow path resistance of the discharge flow path 230. Therefore, when the liquid chambers 210 and the nozzles 211 are filled with liquid, it is possible to efficiently fill the liquid chamber 210 and the nozzle 211 with liquid through the communication flow paths 220.

B. Second Embodiment

Figure 9:
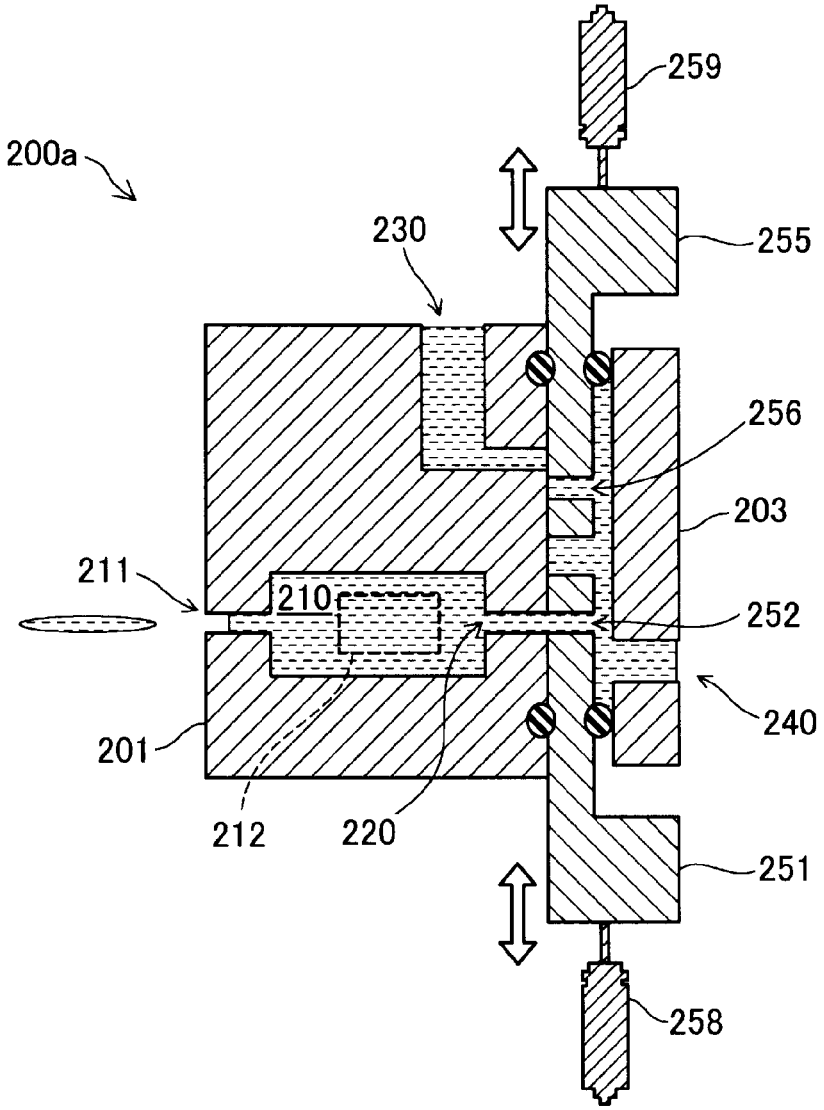
FIG. 9 is a cross-sectional view illustrating a schematic configuration of a head unit of a second embodiment.

FIG. 9 is a cross-sectional view illustrating a schematic configuration of a head unit 200*a* of a second embodiment. In the first embodiment, the slide portion 250 integrally includes the first slide portion 251 and the second slide portion 255. On the other hand, in the second embodiment, the first slide portion 251 and the second slide portion 255 are formed as separate bodies. The first slide portion 251 and the second slide portion 255 are respectively provided with the actuators 258 and 259.

According to such a configuration, because the first slide portion 251 and the second slide portion 255 can be individually moved, the flow path resistance of the communication flow paths 220 and the flow path resistance of the discharge flow path 230 can be individually adjusted. Therefore, for example, after the discharge flow path 230 is completely closed by the second slide portion 255, it is possible to easily adjust the opening and closing timings of the communication flow paths 220 and the supply flow path 240 by moving the first slide portion 251 so as to make the communication flow paths 220 communicate with the supply flow path 240.

C. Third Embodiment

Figure 10:
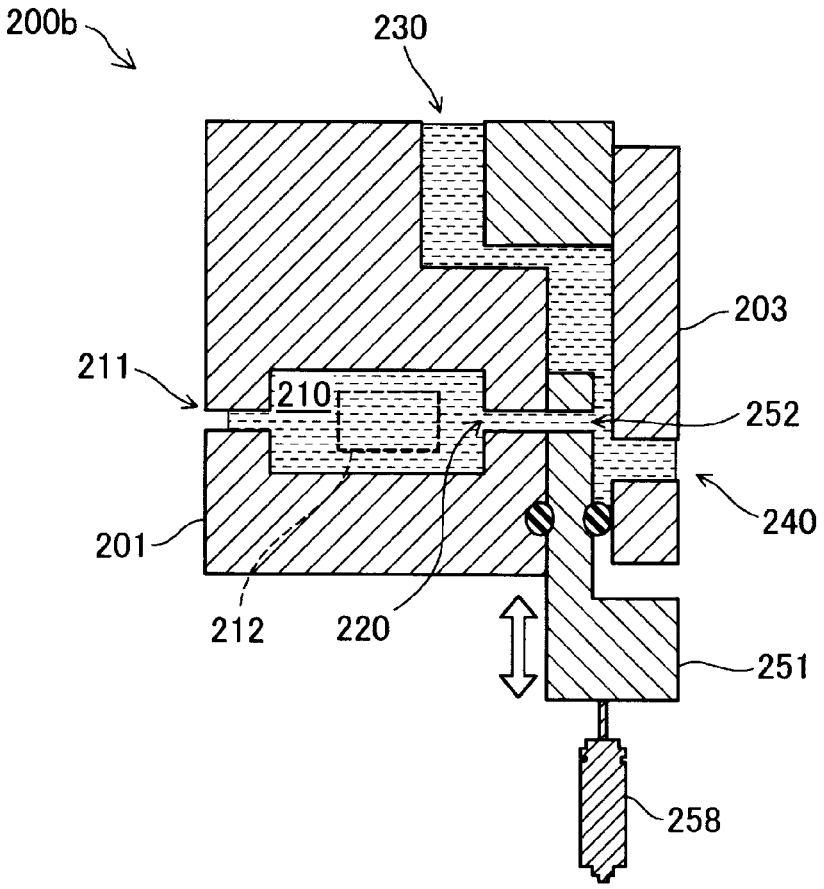
FIG. 10 is a cross-sectional view illustrating a schematic configuration of a head unit of a third embodiment.

FIG. 10 is a cross-sectional view illustrating a schematic configuration of a head unit 200*b* of a third embodiment. In the first embodiment and the second embodiment, the head unit 200 includes the first slide portion 251 and the second slide portion 255. In contrast, in the third embodiment, the head unit 200*b* includes only the first slide portion 251, and does not include the second slide portion 255. Therefore, the discharge flow path 230 is always in the open state. In such a configuration, in the filling state in which the liquid is filled in the nozzles 211 and the liquid chambers 210, the liquid is diverted into the communication flow paths 220 and the discharge flow path 230 and is supplied into the liquid chambers 210. However, even with this configuration, because the liquid can be discharged from the discharge flow path 230, it is possible to release the heat generated by the sliding of the first slide portion 251. Further, in this embodiment, the opening area of the second opening 231 of the discharge flow path 230 may be made smaller than the opening area of the first openings 221 of the communication flow paths 220. If the opening area of the second opening 231 is smaller than the opening area of the first openings 221, the liquid can be quickly supplied to the liquid chambers 210 and the nozzles 211 in the filling state.

D. Fourth Embodiment

Figure 11:
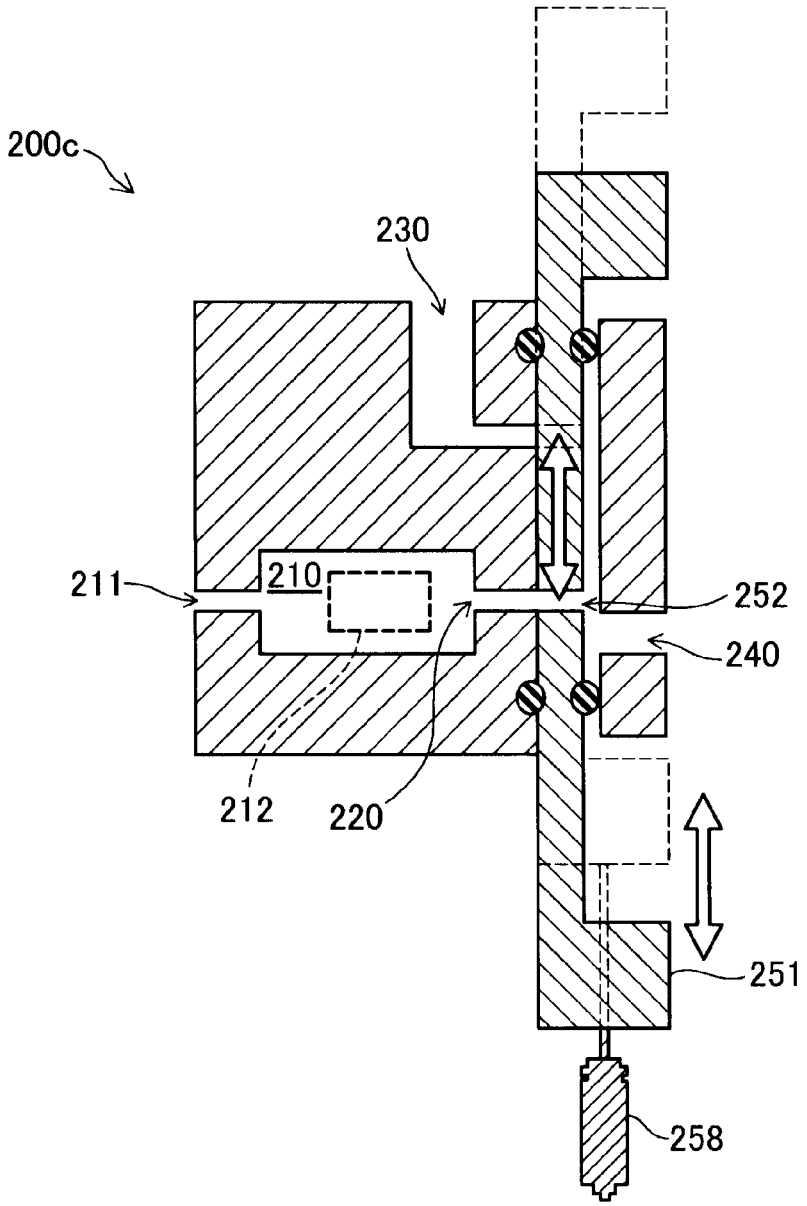
FIG. 11 is a cross-sectional view illustrating a schematic configuration of a head unit of a fourth embodiment.

FIG. 11 is a cross-sectional view illustrating a schematic configuration of a head unit 200*c* of a fourth embodiment. In the first embodiment, the flow path resistance of the communication flow paths 220 is changed by the first through holes 252 provided in the first slide portion 251, and the flow path resistance of the discharge flow path 230 is changed by the second through hole 256 provided in the second slide portion 255. On the other hand, the head unit 200*c* of the fourth embodiment does not include the second slide portion 255 but includes only the first slide portion 251, and the first slide portion 251 changes the flow path resistance of the communication flow paths 220 and the flow path resistance of the discharge flow path 230 by changing the positions of the first through holes 252 between the communication flow paths 220 and the discharge flow path 230.

According to such a configuration, because the first through holes 252 provided in the first slide portion 251 can be used for both liquid supply and liquid discharge, the structure can be simplified. In addition, with such a configuration as well, because the liquid can be discharged from the discharge flow path 230, it is possible to release the heat generated along with the sliding of the first slide portion 251 to the outside.

E. Fifth Embodiment

Figure 12:
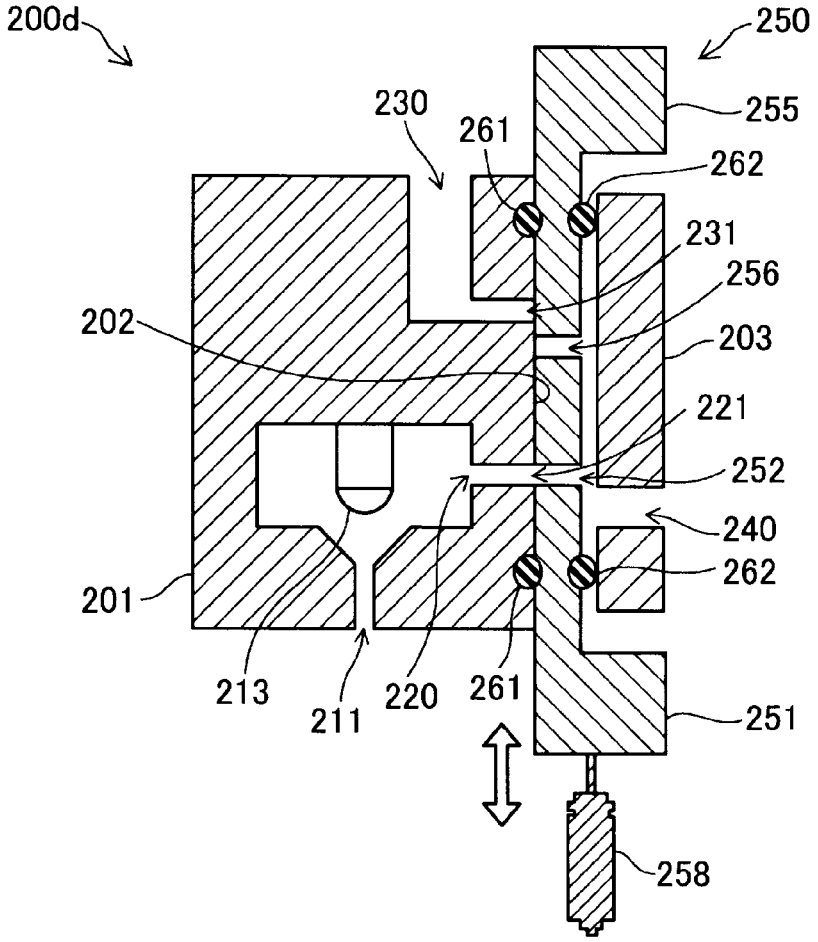
FIG. 12 is a cross-sectional view illustrating a schematic configuration of a head unit of a fifth embodiment.

FIG. 12 is a cross-sectional view illustrating a schematic configuration of a head unit 200*d* of a fifth embodiment. In the above embodiments, the volume of the liquid chamber 210 is changed by the vibration plate 212 provided on a portion of the side surface of the liquid chamber 210 and the piezo actuator in contact with the vibration plate 212. On the other hand, in the fifth embodiment, the volume of the liquid chamber 210 is changed by a moving body 213 provided in the liquid chamber 210. The moving body 213 is driven by any of various actuators such as a piezo actuator and changes the volume inside the liquid chamber 210 by moving inside the liquid chamber 210 toward the nozzle 211. The moving body 213 can also be called a piston or a plunger. In this embodiment, the control unit 80 controls the moving body 213 to cause the moving body 213 to approach or collide with the inner wall surface on which the nozzle 211 is provided, thereby causing the liquid to be ejected from the nozzle 211. As described above, the mechanism for ejecting the liquid from the nozzle 211 is not limited to a mechanism formed of the piezo actuator and the vibration plate 212, and any of various mechanisms can be adopted.

F. Other Embodiments

In the above embodiment, the control unit 80 slides the first slide portion 251 every time the liquid is ejected in order to efficiently eject the liquid from the nozzle 211. On the other hand, for example, the control unit 80 may slide the first slide portion 251 to adjust the amount of liquid ejected.

The invention is not limited to a liquid ejecting apparatus that ejects ink and can also be applied to any liquid ejecting apparatus that ejects liquid other than ink. For example, the invention is applicable to various kinds of liquid ejecting apparatuses as follows.

(1) An image recording apparatus such as a facsimile apparatus.

(2) A color material ejecting apparatus used for manufacturing a color filter for an image display device such as a liquid crystal display.

(3) An electrode material ejecting apparatus used for forming electrodes of organic EL (ElectroLuminescence) displays, field emission displays (FEDs) and the like.

(4) A liquid ejecting apparatus for ejecting a liquid containing bioorganic matter used for biochip manufacture.

(5) A sample ejecting apparatus as a precision pipette.

(6) A lubricating oil ejecting apparatus.

(7) A resin liquid ejecting apparatus.

(8) A liquid ejecting apparatus that ejects lubricating oil pinpoint to a precision machine such as a watch or a camera.

(9) A liquid ejecting apparatus for ejecting a transparent resin liquid such as an ultraviolet curable resin liquid onto a substrate to form a micro hemispherical lens (optical lens) or the like used for an optical communication element or the like.

(10) A liquid ejecting apparatus for ejecting an acidic or alkaline etching solution for etching a substrate or the like.

(11) A liquid ejecting apparatus including a liquid ejecting head for ejecting any other liquid droplets in a minute amount.

Further, "droplet" refers to a state of liquid ejected from a liquid ejecting apparatus, and droplets have, for example, a granular shape, a teardrop shape, or a thread-like shape leaving a trail. In addition, as used herein, the term "liquid" may be any material that can be consumed by a liquid ejecting apparatus. For example, the term "liquid" may refer to any material as long as the material is in a liquid phase, for example, liquid materials such as materials having a high or low viscosity state, sols, gel water, other inorganic solvents, organic solvents, liquid resin and liquid metal (metal melt) are also covered by the term "liquid". In addition, not only liquid as one state of matter, but also particles of a functional material composed of a solid material such as pigment and metal particles dissolved, dispersed or mixed in a solvent are covered by the term "liquid". Representative examples of liquids include ink and liquid crystal. Herein, examples of ink include various liquid compositions such as general water-based ink and oil-based ink, gel ink, hot melt ink and the like.

The invention is not limited to the above-described embodiments, and can be realized in various configurations without departing from the gist thereof. For example, the technical features of the embodiments corresponding to the technical features in each of the aspects described in the summary of the invention may be used to solve some or all of the above-mentioned problems, and may be replaced or combined as necessary in order to accomplish some or all of the effects of the invention. In addition, unless technical features are described as essential in this specification, they can be deleted as appropriate.

The entire disclosure of Japanese Patent Application No.: 2017-125945, filed Jun. 28, 2017 is expressly incorporated by reference herein.

What is claimed is:

1. A liquid ejecting apparatus comprising:

a liquid chamber that communicates with a nozzle;

a communication flow path that communicates with the liquid chamber and that has a first opening into which a liquid flows;

a discharge flow path that discharges the liquid and that has a second opening into which the liquid flows, wherein the discharge flow path does not communicate with the liquid chamber;

a supply flow path capable of supplying the liquid to the communication flow path and the discharge flow path; and a first slide portion disposed between the supply flow path and the communication flow path and having a first through hole that enables the supply flow path to communicate with the communication flow path, wherein the first slide portion, by sliding along an opening surface of the first opening, changes a position of the first through hole with respect to the communication flow path and changes a flow path resistance of the communication flow path, wherein an actuator moves the first slide portion according to a control received from a control unit.

2. The liquid ejecting apparatus according to claim 1, wherein the first slide portion, by changing the position of the first through hole between the communication flow path and the discharge flow path, changes the flow path resistance of the communication flow path and a flow path resistance of the discharge flow path.

3. The liquid ejecting apparatus according to claim 1, further comprising:

a second slide portion disposed between the supply flow path and the discharge flow path and having a second through hole that enables the supply flow path to communicate with the discharge flow path, wherein the second slide portion, by sliding along an opening surface of the second opening, changes a position of the second through hole with respect to the discharge flow path and changes a flow path resistance of the discharge flow path, wherein the actuator moves the second slide portion according to the control received from the control unit.

4. The liquid ejecting apparatus according to claim 3, further comprising:

a slide portion integrally having the first slide portion and the second slide portion.

5. The liquid ejecting apparatus according to claim 3, wherein when the liquid is ejected from the nozzle, the first slide portion increases the flow path resistance of the communication flow path, and the second slide portion reduces the flow path resistance of the discharge flow path.

6. The liquid ejecting apparatus according to claim 3, wherein when the nozzle is filled with the liquid, the first slide portion reduces the flow path resistance of the communication flow path, and the second slide portion increases the flow path resistance of the discharge flow path.

7. The liquid ejecting apparatus according to claim 1, wherein when the liquid is ejected from the nozzle, the first slide portion increases the flow path resistance of the communication flow path.

8. The liquid ejecting apparatus according to claim 1, wherein an opening area of the second opening is larger than an opening area of the first opening.

9. The liquid ejecting apparatus according to claim 1, wherein a force that the first slide portion receives from a side of the supply flow path is larger than a force that the first slide portion receives from a side of the communication flow path.

10. The liquid ejecting apparatus according to claim 1, further comprising:

a plurality of sets of the liquid chamber and the communication flow path, wherein the first slide portion changes a flow path resistance of a plurality of the communication flow paths.

11. The liquid ejecting apparatus according to claim 1, wherein the first slide portion slides each time the liquid is ejected from the nozzle.

12. A liquid ejection method executed by a liquid ejecting apparatus that includes a liquid chamber that communicates with a nozzle, a communication flow path that communicates with the liquid chamber and that has a first opening into which a liquid flows, a discharge flow path that discharges the liquid and that has a second opening into which the liquid flows, wherein the discharge flow path does not communicate with the liquid chamber, a supply flow path capable of supplying the liquid to the communication flow path and the discharge flow path, and a first slide portion disposed between the supply flow path and the communication flow path and having a first through hole that enables the supply flow path to communicate with the communication flow path, wherein an actuator moves the first slide portion according to a control received from a control unit, the liquid ejection method comprising:

allowing the first slide portion to change a flow path resistance of the communication flow path by changing a position of the first through hole with respect to the communication flow path by sliding along an opening surface of the first opening; and increasing the flow path resistance of the communication flow path by the first slide portion when the liquid is ejected from the nozzle.

* * * * *